United States Patent [19]

Priaroggia

[11] 3,986,377

[45] Oct. 19, 1976

[54] APPARATUS FOR SHEATHING A CABLE CORE WITH CORE SURROUNDED BY IMPREGNATING FLUID DURING SHEATHING

[75] Inventor: Paolo Gazzana Priaroggia, Milan, Italy

[73] Assignee: Industrie Pirelli S.p.A.., Milan, Italy

[22] Filed: May 19, 1975

[21] Appl. No.: 578,877

Related U.S. Application Data

[62] Division of Ser. No. 517,789, Oct. 24, 1974, Pat. No. 3,918,281.

[30] Foreign Application Priority Data

Nov. 21, 1973 Italy ..... 397/73

[52] U.S. Cl. ..... 72/38; 29/202.5; 72/46; 72/258

[51] Int. Cl.[2] ..... B21C 23/30; H01B 13/24

[58] Field of Search ..... 29/202.5, 473.3, 474.3; 72/38, 46, 258, 268; 118/50, 409; 156/48, 51, 53, 54

[56] References Cited

UNITED STATES PATENTS

| | | | |
|---|---|---|---|
| 2,115,574 | 4/1938 | Gasser | 156/48 |
| 2,981,409 | 4/1961 | Colleoni | 72/38 X |
| 3,032,464 | 5/1962 | Grieve | 156/51 X |
| 3,514,349 | 5/1970 | Shiroya et al. | 156/48 |
| 3,561,250 | 2/1971 | Oriani | 72/402 |
| 3,587,522 | 6/1971 | Baskwell | 118/50 |
| 3,854,444 | 12/1974 | Franke et al. | 156/48 |

FOREIGN PATENTS OR APPLICATIONS

| | | | |
|---|---|---|---|
| 604,983 | 11/1934 | Germany | 156/48 |
| 1,217,738 | 12/1970 | United Kingdom | 156/48 |
| 1,234,397 | 6/1971 | United Kingdom | 156/48 |

*Primary Examiner*—C.W. Lanham
*Assistant Examiner*—E. M. Combs
*Attorney, Agent, or Firm*—Brooks Haidt Haffner & Delahunty

[57] ABSTRACT

A process for sheathing a cable core with metal in which the core is immersed in oil in a container and is transferred from the container to the sheath extruder in a siphon tube in which oil flows in a direction opposite to the direction of movement of the core. From the extruder, the metal sheathed core is transferred to a drum and during such transfer the core is subjected to oil under pressure. Prior to inserting the core in the siphon tube, the latter is evacuated and filled with degassed oil. The apparatus comprises a stainless steel siphon tube with one end in the container and the other end connected to the extruder. The siphon tube has a higher intermediate portion to which a piezometric column and a pump are connected and has a coupling adjacent the extruder for supplying degassed oil to the siphon tube.

8 Claims, 3 Drawing Figures

APPARATUS FOR SHEATHING A CABLE CORE WITH CORE SURROUNDED BY IMPREGNATING FLUID DURING SHEATHING

This is a division of application Ser. No. 517,789 filed Oct. 24, 1974, now U.S. Pat. No. 3,918,281.

The present invention relates to a process and apparatus for covering a core impregnated with fluid oil with a metal sheath which are particularly useful for manufacturing submarine cables of long length and without joints. As used herein, the term "core" means a conductor, generally insulated with cellulose paper and preferably, but not necessarily, wrapped with metallized cloth.

In the known processes for the formation of oilfilled cables having a metal sheath outer covering, the core is first collected in coils in a pan in the shape of a toroidal container situated in a closed autoclave and is dried under high vacuum and then impregnated. After impregnation, the core is immersed in the pan or tank in a degassed oil bath and under a head, namely, is submersed for about 10 centimeters under the surface of the bath. At this time the autoclave is opened, the pan is removed and is transferred, together with the core contained therein, to a position upstream of an extrusion press, i.e., apparatus able to extrude a metal sheath, for example, of lead or aluminum over the core.

From this point, in certain processes practiced in Europe, knowledge of which is restricted to certain authorized personnel and which has not been publicly disclosed the core to be sheathed passes to the extruder through a siphon tube connected at one end to the extruder by means of a vacuum-tight connection tube which extends to the mandrel of the extruder. In said process, a piezometric column, where vacuum has been previously created, is situated at the highest point of the siphon system, and in general, is connected to it by means of a check valve. At the top of the piezometric column the high vacuum is applied which permits the carrying out of that stage in the sheathing process which in the present description is defined as first stage or treatment stage. Such stage comprises subjecting the system for transferring the core from the immersion bath to the sheath extrusion position to a high vacuum. The expression "transferring system" means herein at least the siphon tube connected to the piezometric column, at least a portion of the extruder and the length of cable having an extruded sheath thereon and having a sealed end, which will be described hereinafter. The vacuum treatment consists essentially of a series of operations intended to eliminate almost all traces of air or moisture from the transferring system.

In said certain processes, when the extruder has been started and begins to operate, a plug connected at one end to a drawing rope and connected to the cable extremity at the other end is caused to pass into the siphon tube a distance sufficient to reach the sheath to be extruded, with which it engages. At this time, the check valve connecting the piezometric column to the siphon tube is opened and a turbulent mass of oil and foam flows up the siphon tube to the piezometric column and primes it, so that the oil coming from the immersion bath flows towards the vacuum-tight tube connected to the extruder and the tube of extruded metal until they are filled. After a few minutes the foam disappears, but unfortunately, this does not mean that all the air and moisture previously present in the transferring system are eliminated. On the contrary, the risk of air and moisture absorption by the external papers wound around the core conductor remains a factor during the second stage, or transferring stage, namely, from the time the core end is introduced in the sheath, and for the whole sheating operation, until the sheathing of the core is completed.

In some prior art embodiments, attempts have been made to minimize the risk of air and moisture absorption by the insulating paper of the core by supplying degassed oil under pressure to the "lower" end of the core coils, the expression "lower" meaning herein the core end opposite to that secured to the drawing rope. However, because of the permeability of the paper, the oil passes through said paper, and after the passage thereof along a core length of about 50 meters, the oil has already left the oil duct of the core and has passed into the tank containing the core coils.

The same unsatisfactory result is obtained with the weak stream of degassed oil coming from the feeding of oil to the drawing end of the cable which commences when the latter reaches the take-up bobbin or reel.

Moreover, in said certain processes in use at present, the extruded sheath at the outlet of the extruder and the stored cable downstream of the extruder always is partially or totally situated at a level higher than the oil surface level in the tank containing the core to be sheathed, and serious damage to the cable can result by undergoing a lowering of pressure in the last stage of the sheathing process. The last stage is herein defined as a third stage, or completion stage, which is that stage providing, in addition to the sheathing of the core, the storage of the finished cable.

The present invention has, as one object, the elimination of the disadvantages described hereinbefore by providing a process, and apparatus for carrying out the process, by means of which it is possible to produce sheathed cables devoid of any trace of gas even in long lengths.

More particularly, the principal object of the present invention is a process for the metal sheathing of an impregnated core, which comprises a first stage in which the core transferring system which extends from the immersion bath to the sheath being extruded and provided with an end seal is subjected to a high vacuum, a second stage in which the core is transferred and a third stage in which the sheathed cable is completed and stored. The preferred embodiment of the invention comprises the following steps:

1. in said first stage, a high vacuum is first produced in the transferring system and subsequently, said system is supplied with degassed fluid oil under pressure;

2. in said second stage of transferring the core, after the transferring system is filled with degassed fluid oil under pressure, said transferring system is connected under head with said immersion bath, the supply of degassed oil under pressure is continued until a strong, continuous stream directed from the transferring system to the immersion bath is obtained, and then the core is pushed in the transferring system in a sense opposite to the motion of said stream to facilitate washing of the outer layers of the core insulation;

3. in said third or completion stage, the core is mechanically connected to the metal sheath, and said core, as it is being covered with the metal sheath and stored on an appropriate means, is kept at a pressure higher than the atmospheric pressure acting on the surface level of the oil bath.

A further object of the present invention is apparatus for carrying out the process described hereinbefore, in which apparatus said transferring system is a siphon tube which is connected at its highest point to a piezometric tube which can be connected to a vacuum pump and which siphon tube is connected at one end with a vacuum-tight tube reaching the mandrel of the extruder. Said siphon tube preferably is a tube of stainless steel provided with a coupling for feeding thereto the degassed oil under pressure, said tube having the opening at its opposite, free end provided with a closing means which permits closing of such end in a vacuum-tight manner before producing the high vacuum during the first stage.

Other objects of the invention will be apparent from the following detailed description of a presently preferred embodiment of the invention, which description should be considered in conjunction with the accompanying drawings in which.

Figures 1, 2, 3:
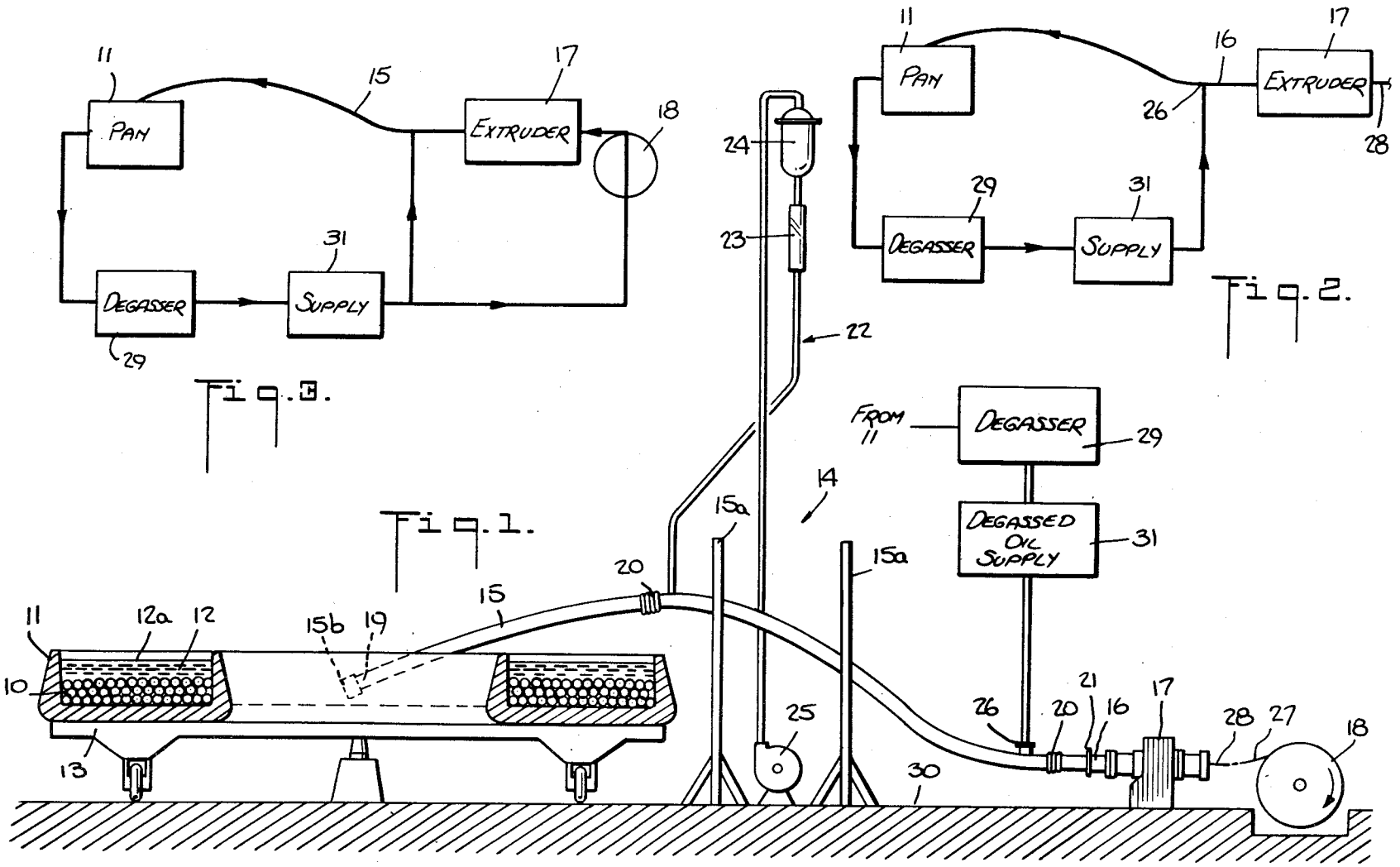
FIG. 1 is a diagrammatic, side elevation view of a plant for manufacturing a sheathed cable impregnated with fluid oil according to the process of the invention.
FIG. 2 is a schematic diagram showing the circulation of the fluid oil in the plant before collecting the cable on a bobbin or reel.
FIG. 3 is a schematic diagram showing the circulation of the fluid oil in the plant after collecting the already sheathed core on the bobbin.

A core 10, intended to form part of an electric cable impregnated with fluid oil, is at first collected in coils in a pan 11 which may, for example, be a toroidal container of the type described in Italian Pat. No. 721,804 and the Patent of Addition No. 801,543. The core 10 has previously been situated in a closed autoclave (not shown) where it is dried under high vacuum and then impregnated with oil. After impregnation, the core 10 is immersed in a bath of degassed fluid oil in the pan 11 and is placed under the surface 12*a* of the oil 12 a distance of at least about 10 centimeters, namely, with the highest point of the core 10 at at least about 10 centimeters below the surface 12*a* of the oil bath.

The pan 11, together with the core 10 arranged inside it, is then transported by an appropriate means, for example, a crane (not shown) to a rotatable platform 13 situated upstream of the sheathing portion 14 of the plant.

The "lower", or trailing, end of the core 10 is sealed in any suitable manner and the other, or leading, end of the core 10 has an ogival shape in longitudinal cross-section so as to facilitate its passage into a siphon tube as described hereinafter.

The sheathing portion 14 of the plant comprises a siphon tube 15, a vacuum-tight connection tube 16, a conventional extruder 17 for extruding a sheath of metal, e.g., lead or aluminum, over the core 10 and at least a collecting bobbin or drum 18. The free end 19 of the siphon tube 15 is in the oil 12 in the pan 11 and is provided with a closing means 15*b*, for example, a plug which permits closing of its end in a vacuum-tight manner. The siphon tube 15 is preferably composed of a tube of stainless steel having a specular inner surface, and the tube 16 may be of the type shown and described in U.S. Pat. No. 2,981,409. The cross-section of the siphon tube 15 has an inner diameter greater than the outer diameter of the core 10 and can have, for example, an inner diameter which is double the outer diameter of the core 10.

The siphon 15 is provided with one or more elastic joints 20. In a preferred embodiment, the steel tube 15 is made from several tubular pieces joined together by flexible, corrugated tubular bodies (elastic joints) which impart to the tube 15 a certain flexibility.

The siphon tube 15 is also supported, in one or more zones, by appropriate supports 15*a*, for example, of the trellis type, which permit horizontal and vertical displacement of the tube 15. The other end 21 of the siphon tube 15 is connected to the first free end of the vacuum-tight connecting tube 16, of a conventional type, provided at the extruder 17 and reaching the mandrel of the same.

It is to be noted that the output of the extruder 17 is at a height above the floor 30 which is less than the height of the surface 12*a* of the oil bath 12 so that it is below the upper level of the oil bath 12. The extruder 17 is suitable for extruding lead or aluminum, depending on whether the cable is to be sheathed with one material or the other.

Downstream of the extruder 17, there is a suitable bobbin or drum 18 for collecting or storing the cable 27 which comprises the core 10 covered with the metal sheath. The drum 18 has its highest point situated at a level below the upper surface level 12*a* of the fluid oil 12 in the pan 11.

Other apparatus, for example, a corrugator for the sheath, if this is made of aluminum, a winding regulator, a cooling tank, etc., can be provided, if necessary or desired, between the extruder 17 and the drum 18.

A piezometric column 22 is connected to the siphon tube 15 at the highest point of the siphon tube 15. Said column 22 is provided at its upper end with a transparent sight tube 23 and a vacuum tank 24 connected to a vacuum pump 25.

A coupling 26 is provided at one of the lowest points of the siphon tube 15 upstream of the extruder 17 and in proximity to it. In particular, the coupling 26 is at a short distance from the free end of the vacuum-tight connection tube 16 of the extruder 17 and said coupling 26 serves to connect the siphon tube 15 with a supply 31 of degassed oil coming from a degasser 29 for the oil of the plant.

After having removed the pan 11 containing the core 10 from the autoclave where it has been dried and impregnated and placed the core on the rotatable platform 13, the oil 12 covering the core 10 tends to absorb air, but the core 10 is temporarily protected because it is under an oil head of preferably at least 10 centimeters.

At this point, the first stage of the process, that is the stage of treatment of the transferring system, is started. A short section 28 of the sheath is extruded and sealed at its outward end. The free end 19 of the siphon tube 15 is closed with the closing means 15*b*, e.g., a plug, and vacuum is created in the transferring system by means of the vacuum pump 25. The expression "transferring system" means the portion 28 of extruded sheath with its sealed end, the extruder 17, the vacuum-tight connecting tube 16, the siphon tube 15 and the piezometric column 22.

When the vacuum is appropriate, namely, is about 0.01 mm/Hg, degassed oil, coming from the supply 31 connected to the plant oil degasser 29, is sent to the siphon tube 15 through the coupling 26.

When the oil reaches a predetermined level in the piezometric tube 22 and is visible through the transparent tube 23, while the supply of degassed oil through the coupling 26 is continued, the plug closing the free end 19 of the siphon tube 15 is removed while said end 19 is immersed under head in the oil 12 in the pan 11. Degassed oil is therefore transferred to the pan 11 through the siphon tube 15. The pan 11 is provided with one or more overflow outlets (not shown) situated in a position diametrically opposite to the free end 19. Such outlets send oil back to the degasser practically in the same amount as is supplied to the transferring system.

In this way, a strong, continuous, closed-circuit circulation stream is produced which, in about half-an-hour, is able to renew completely the oil 12 in the pan 11, thereby maintaining the oil degassing degree at an acceptable level. FIG. 2 illustrates diagrammatically the oil flow at this time, and it will be noted that the oil circulates in a closed path.

At this time it is possible to begin the step indicated in the present description as the "transferring stage", in which the operator takes the ogival, leading end of the core 10 and, while maintaining it under the oil 12, pushes it into the siphon tube 15 through the opening of the free end 19, also under the oil 12. This preliminary operation of insertion of the end is facilitated by pushing it into the siphon tube 15 as the pan 11 and the platform 13 are manually rotated. Then, the platform 13 is placed into automatic, driven rotation, and the core 10, pushed by the rotation of the pan 11 and aided by the ogival shape of its end, by the presence of the extremely fluid oil in the siphon tube 15 and by the specular inner surface of the latter, travels easily into the siphon tube 15 until it reaches the vacuum-tight tube 16 and enters the extruder 17.

The continuous stream of the fluid oil provided as shown in the diagram of FIG. 2, meets the core 10 in a sense opposite to the motion of the latter, namely, in counter-current thereto, and exerts a strong washing effect on the outer layers of the insulation thereby removing the gas traces which may exist on the insulation. Such gas traces, in any case, would be very small because the core 10 does not come into contact with air and is protected by a layer of fluid oil 12 which is rapidly renewed by the oil flowing from the free end 19 of the siphon tube 15.

When the end of the core 10 reaches the extruder 17, the core 10 is pulled along in the extruder as it is covered with the metal sheath.

At this time, it is possible to begin the step defined in the present description as third stage or completion stage. After having subjected the core 10 covered with the metal sheath to conventional processes as desired, for example, after cooling and corrugation of the sheath, if this is made of aluminum, the metal sheath is mechanically connected to the end of the core 10, namely, said sheath engages on the O-rings of said end of the core 10 as described, for example, in U.S. Pat. No. 3,342,162 and as indicated in U.S. Pat. No. 3,561,250. The excess portion of the sheath is then removed in order to open the cable oil duct which is connected to the degasser 29, in a known manner, at the time at which the core 10 provided with the sheath, that is, the formed cable, begins to be wound up on the drum 18. As illustrated in FIG. 3, such oil from the degasser 29, which has a head of pressure greater than that of the oil 12 in the pan 11, passes through the central duct of the sheathed cable and then passes through the insulating papers into the tube 15, thereby increasing the counter-current of oil for washing the core 10 in the siphon tube 15.

The plant of FIG. 1 illustrates the case in which the impregnation with fluid oil of the core 10, comprising at least a conductor and the insulating papers, but preferably also provided with an outer winding of metallized cloth, has taken place in the toroidal container 11 immersed in a normal impregnation tank or autoclave and then, transported on the rotatable platform 13 after impregnation. However, it is clear that the same plant and the same process can be applied also when the treatment of the core 10 and its subsequent impregnation take place on the same rotatable platform 13 supporting a toroidal container acting as an impregnation tank.

The pan type impregnating system is, however, the preferred one, since it affords the advantage of obtaining considerable savings with respect to the tank impregnation system. In fact, the former permits the pan 11 to be left clean and can be immediately used for other impregnation cycles or for other impregnation systems, for example, with viscous compounds rather than with fluid oil.

Although a preferred embodiment of the present invention has been described and illustrated, it will be understood by those skilled in the art that various modifications may be made without departing from the principles of the invention.

What is claimed is:

1. Apparatus for sheathing an impregnated core having a conductor surrounded by insulation and at least one oil passageway in said core, said apparatus comprising a container for said core, an extruder spaced from said container for extruding a metal sheath on said core, a siphon tube extending from said container to said extruder and connected at one end to said extruder and having a free end at said container, said tube having a portion intermediate its ends which is higher than said ends, a piezometric tube connected to and extending above said portion, pump means connected to said piezometric tube for evacuating the latter and said siphon tube, a source of degassed oil, coupling means on said siphon tube for connecting said source of degassed oil to said siphon tube and means for closing said free end of said siphon tube to permit the evacuation thereof.

2. Apparatus as set forth in claim 1, wherein said siphon tube is made of stainless steel.

3. Apparatus as set forth in claim 2, wherein said siphon tube has a specular inner surface.

4. Apparatus as set forth in claim 1, wherein the inner diameter of said siphon tube is at least twice the outer diameter of said core.

5. Apparatus as set forth in claim 1, wherein said coupling means is intermediate said portion of said siphon tube and said extruder and is adjacent to the latter.

6. Apparatus as set forth in claim 1, wherein said siphon tube comprises a plurality of relatively rigid sections interconnected by flexible joints.

7. Apparatus as set forth in claim 6, wherein said joints are corrugated tubular bodies.

8. Apparatus as set forth in claim 1, further comprising means for receiving and storing a sheathed core from said extruder and wherein said container has oil therein having a predetermined upper surface level, wherein said extruder has an outlet for said core with a sheath thereon and wherein said outlet and said last-mentioned means are located at a level below said surface level.

* * * * *

UNITED STATES PATENT AND TRADEMARK OFFICE

CERTIFICATE OF CORRECTION

PATENT NO. : 3,986,377

DATED : October 19, 1976

INVENTOR(S) : Paolo Gazzana Priaroggia

It is certified that error appears in the above-identified patent and that said Letters Patent are hereby corrected as shown below:

Identifier [30] Foreign Application Priority Data:

"397/73" should read --31497/73--

Col. 1, line 16 - "oilfilled" should read --oil-filled--

Col. 2, line 6 - "sheating" should read --sheathing--

Col. 4, line 51 - after "is" insert a comma

Signed and Sealed this

Twenty-first Day of December 1976

[SEAL]

*Attest:*

RUTH C. MASON
*Attesting Officer*

C. MARSHALL DANN
*Commissioner of Patents and Trademarks*